US011999557B2

(12) United States Patent
Dayioglu et al.

(10) Patent No.: US 11,999,557 B2
(45) Date of Patent: Jun. 4, 2024

(54) CONTAINER HAVING SLIDING LID AND LOCKING MECHANISM

(71) Applicant: PHILIP MORRIS PRODUCTS S.A., Neuchatel (CH)

(72) Inventors: Onur Dayioglu, Neuchatel (CH); Ross Lange, Neuchatel (CH); Julie Polier, Neuchatel (CH); Luiz Andre Rodrigues, Neuchatel (CH); Digvijay Singh, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/634,474

(22) PCT Filed: Aug. 14, 2020

(86) PCT No.: PCT/EP2020/072868
§ 371 (c)(1),
(2) Date: Feb. 10, 2022

(87) PCT Pub. No.: WO2021/032619
PCT Pub. Date: Feb. 25, 2021

(65) Prior Publication Data

US 2022/0297927 A1 Sep. 22, 2022

(30) Foreign Application Priority Data

Aug. 16, 2019 (EP) ..... 19192182

(51) Int. Cl.
*B65D 85/10* (2006.01)
*B65D 5/66* (2006.01)

(52) U.S. Cl.
CPC ..... *B65D 85/10564* (2020.05); *B65D 5/6691* (2013.01)

(58) Field of Classification Search
CPC ..... B65D 85/10564; B65D 5/6691; B65D 5/6688; B65D 5/6673; B65D 5/6632
(Continued)

(56) References Cited

U.S. PATENT DOCUMENTS 2,358,802 A * 9/1944 Glover ..... B65D 5/68 206/268
3,311,283 A * 3/1967 Shimada ..... B65D 5/6688 206/250

(Continued)

FOREIGN PATENT DOCUMENTS

DE 102007009251 8/2008
EP 1 466 844 10/2004

(Continued)

OTHER PUBLICATIONS

Extended European Search Report for Application No. 19192182.4 dated Jan. 27, 2020 (7 pages).

(Continued)

*Primary Examiner* — Rafael A Ortiz
(74) *Attorney, Agent, or Firm* — Mueting Raasch Group

(57) ABSTRACT

A container (1) for consumer goods, the container comprises an outer housing comprising a box portion (60) and a lid portion (50). The lid portion (50) is linearly movable relative to the box portion between a closed position, in which the lid portion covers the access opening, and an open position, in which the access opening is exposed. The container (1) comprises a locking mechanism configured to transition between: a locked state, in which the lid portion (50) is prevented from moving linearly from the closed position to the open position; and an unlocked state, in which the lid portion (50) is able to move linearly from the closed position to the open position.

15 Claims, 4 Drawing Sheets

(58) Field of Classification Search
USPC ..... 206/273, 271, 268, 231, 267, 265, 248, 206/242, 1.5
See application file for complete search history.

(56) References Cited

U.S. PATENT DOCUMENTS

| | | | | | |
|---|---|---|---|---|---|
| 3,400,874 | A * | 9/1968 | Shimada | B65D 5/6688 | 206/250 |
| 4,646,960 | A * | 3/1987 | Challand | B65D 85/1054 | 206/273 |
| 6,296,175 | B1 | 10/2001 | Dixon | | |
| 6,474,468 | B1 * | 11/2002 | Griffith | B65D 85/1054 | 229/117.03 |
| 7,866,466 | B2 * | 1/2011 | Rose | B65D 85/1036 | 206/270 |
| 9,254,938 | B2 * | 2/2016 | Iwata | B65D 85/1054 | |
| 2011/0062175 | A1 * | 3/2011 | Nakamura | B65D 85/1054 | 220/810 |
| 2013/0140201 | A1 * | 6/2013 | Ghini | B65D 85/1036 | 206/267 |

FOREIGN PATENT DOCUMENTS

| | | | | |
|---|---|---|---|---|
| EP | 1466844 | A1 * | 10/2004 | B65D 5/38 |
| EP | 1 884 468 | | 2/2008 | |
| EP | 1626916 | | 9/2014 | |
| GB | 417315 | | 10/1934 | |
| GB | 1 559 807 | | 1/1980 | |
| WO | WO 01/15998 | | 3/2001 | |

OTHER PUBLICATIONS

PCT International Search Report and Written Opinion for PCT/EP2020/072868 dated Sep. 30, 2020 (9 pages).

* cited by examiner

CONTAINER HAVING SLIDING LID AND LOCKING MECHANISM

This application is a U.S. National Stage Application of International Application No. PCT/EP2020/072868 filed Aug. 14, 2020, which was published in English on Feb. 25, 2021, as International Publication No. WO 2021/032619 A1. International Application No. PCT/EP2020/072868 claims priority to European Application No. 19192182.4 filed Aug. 16, 2019.

The present invention relates to a container for consumer goods. Containers according to the invention find particular application as containers for aerosol generating articles or components of aerosol generating articles.

It is known to package consumer articles in containers formed from folded laminar blanks. By way of example, elongate smoking articles, such as cigarettes and cigars, are often sold in rigid box shaped containers, such as hinged lid containers having a box portion and a three-dimensional cup shaped hinge lid connected to the box about a hinge line extending across the rear wall of the container. In use, the lid is pivoted about the hinge line to open the pack and so gain access to the consumer articles held in the box.

One known prior art container is described in EP1466844. The container has box for housing consumer goods and three-dimensional cup shaped lid for covering an access opening in the top of the box. The lid is linearly movable relative to the box between a closed position in which the lid covers the access opening and an open position, in which the lid has been slid away from the box. When the lid is in the open position the access opening of the box is exposed. Furthermore, when the lid is in the open position it is able to pivot about a hinge relative to the box. This improves access to the consumer goods housed in the box.

It may be desirable to ensure that the lid remains in the closed position until a consumer is ready to access the consumer goods. For example, it may be desirable to ensure that the lid remains in the closed position when the container is being transported. This may help to prevent the consumer goods from inadvertently falling out of the container. This may help to preserve one or more properties of the consumer goods, such as their freshness.

It would be desirable to provide a novel and improved container for consumer goods which is configured to reduce the risk of a lid of the container inadvertently moving from the closed position to the open position. Further, it would be desirable to provide one or more laminar blanks and a method for forming one such improved container, wherein the manufacturing process is straightforward and cost-effective.

According to the present disclosure, there is provided a container for consumer goods. The container comprises an outer housing comprising a box portion and a lid portion. The box portion defines an internal volume for housing consumer goods and has an access opening for providing access to the consumer goods. The lid portion is linearly movable relative to the box portion between a closed position, in which the lid portion covers the access opening, and an open position, in which the access opening is exposed. The container further comprises a lid locking component attached to or integrally formed with the lid portion, and a box locking component provided on the inner surface of a wall of the box portion. The lid locking component and the box locking component form a locking mechanism for the container. When the lid portion is in the closed position, the locking mechanism is configured to transitionable between a locked state, in which a portion of the lid locking component engages with a portion of the box locking component to prevent the lid portion from moving linearly from the closed position to the open position, and an unlocked state, in which the lid locking component is not engaged with the box locking component, and the lid portion is able to move linearly from the closed position to the open position.

By providing the container with such a locking mechanism the container can be left in a locked state when the lid is in the closed position. This means that the container can be locked when not in use. Preferably, the locking mechanism is biased toward keeping the container in a locked state. The locking mechanism may therefore help to reduce the risk of inadvertent opening of the container.

By providing the box locking component on the inner surface of a wall of the box portion, at least a portion of the locking mechanism may be at least partially hidden from view. This may mean that the locking mechanism is less obviously visible. This may help to reduce the risk of the container becoming inadvertently unlocked.

Use of such a locking mechanism in a container having a lid portion which is linearly movable relative to a box portion may also help to reduce the risk of inadvertent opening of the container. This is because the opening action for the container may not be immediately apparent, when compared to the likes of a conventional hinge-lid container, which has a hinge on the container back wall clearly visible.

In the following description of the invention the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "hinge line" is used herein to refer to a line about which the lid may be pivoted in order to open the container. A hinge line may be, for example, a fold line or a score line. The hinge line about which the lid is connected to the box may coincide with an edge of the container, or the hinge line may extend across a wall of the container at a position that is spaced apart from the edges.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

The locking mechanism is configured to be transitionable between the locked state and the unlocked state. This means that the locking mechanism is arranged so that it is able to transition from the locked state to the unlocked state, and from the unlocked state to the locked state, for example in response to a force applied to the container by a consumer.

In some preferred embodiments, the container may be configured so that lid portion can pivot relative to the box portion about a hinge when the lid portion is in the open position. This enhances the access to the interior of the box portion and the consumer goods housed therein by moving the lid portion further away from the access opening of the box portion. The hinge may be defined by a hinge line extending across the container. The hinge line may be disposed at the back of the container. Where the lid portion comprises a lid back wall, the hinge line may coincide with the lower edge of the lid back wall. Where the box portion comprises a box portion back wall, the hinge line may coincide with the upper edge of the box portion back wall.

The container may be configured so that such pivoting motion is only possible when the lid portion is in the open position.

The lid portion may comprise a lid front wall, a lid back wall, a lid top wall and first and second opposing lid side walls. These walls may together provide the lid portion with a three-dimensional cup shape.

The lid front wall, lid back wall and lid side walls may each abut corresponding walls of the box portion, when the lid portion is in the closed position. The lid front wall, lid back wall and lid side walls may each be flush with the corresponding walls of the box portion, when the lid portion is in the closed position.

In some embodiments, the lid locking component is attached to the lid portion, more preferably the lid locking component is attached to the lid back wall. For example, the lid locking component may be formed as a separate component to the lid portion. For example, the lid locking component may be formed from a folded laminar blank and the lid portion may be formed from a separate folded laminar blank. For example, the lid front wall, the lid back wall, the lid top wall and the first and second opposing lid side walls may be formed from a first laminar blank and the lid locking component may be formed from a second laminar blank, the second laminar blank being attached to the first laminar blank at the lid back wall. The attachment may be provided by adhesive or any other suitable means.

In some embodiments, the lid locking component is integrally formed with the lid portion, more preferably the lid locking component is integrally formed with the lid back wall. For example, the lid back wall may be formed from a first laminar blank and the lid locking component may also be formed from the first laminar blank. In such embodiments, the lid locking component may depend directly from the lid back wall. More specifically, the lid locking component may depend directly from the lower edge of the lid back wall.

The lid locking component may extend from the lid back wall into the interior volume of the box portion.

Where the lid locking component is attached to or integrally formed with the lid back wall, the box locking component is preferably provided on the inner surface of the box back wall. Such an arrangement can help to facilitate cooperative engagement between the lid locking component and the box locking component.

The lid locking component may comprise an engagement portion for engaging with the box locking component when the lid portion is in the closed position. The engagement portion of the lid locking component may provide an engagement edge configured to abut a corresponding engagement edge of the box locking component when the lid portion is in the closed position. Selective engagement and disengagement of these engagement edges may correspond to the locking mechanism being transitionable between the locked state and the unlocked state. That is, when the locking mechanism is in the locked state, the engagement edges are abutting one another to prevent the lid portion from moving linearly from the closed position to the open position.

In some embodiments, the lid locking component comprises a first panel hingedly connected to the lid back wall, with the engagement portion of the lid locking component being connected to the first panel. For example, the engagement portion of the lid locking component may comprise an element affixed to the outer surface of the first panel. The element may comprise a strip of material extending across the outer surface of the first panel. In such embodiments, the element may provide the engagement edge of the lid locking component.

Alternatively or additionally, the engagement portion of the lid locking component may comprise a second panel connected to the first panel of the lid locking component. In such embodiments, a free edge of the second panel may provide the engagement edge of the lid locking component.

The second panel may be connected to the first panel by a first fold line. The second panel may be folded about the first fold line such that the second panel is positioned between the first panel of the lid locking component and the wall of the box portion having the box locking component. The first fold line may be provided on a lower edge of the first panel. Such a folded arrangement can provide a simple yet effective way of ensuring that the engagement edge of the lid locking component is generally biased towards the wall of the box portion having the box locking component. This can help to advantageously ensure that the locking mechanism remains in the locked state, when no external force is being applied to the container. Therefore, in some embodiments, at least part of the lid locking component is preferably biased towards engaging with the box locking component when the lid portion is in the closed position.

By providing a first panel, which is hingedly connected to the lid back wall, the lid portion may be provided with a hinge function. In particular, the container may be configured so that when the lid portion is in the open position, the lid portion can pivot relative to the box portion. This can help to improve access to any consumer goods housed in the box portion.

The container may be configured so that such pivoting motion is only possible when the lid portion is in the open position. For example, the box portion may comprise an inner frame. The inner frame may be configured to engage with the lid portion when the lid portion is in the closed position to prevent the lid portion from pivoting relative to the box portion. The inner frame may be configured to continue to prevent such pivoting of the lid portion until the lid portion reaches the open position, when the lid portion is moved from the closed position to the open position. The inner frame may comprise an inner frame front panel. The inner frame may comprise a first inner frame side panel and a second inner frame side panel, the first inner frame side panel and the second inner frame side panel being opposed to each other, and each inner frame side panel being connected to the inner frame front panel at a respective side edge of the inner frame front panel. The inner frame may be configured to prevent pivoting of the lid portion until the lid portion reaches the open position, on account of one or more of the inner frame panels underlying a corresponding lid portion wall to obstruct rotational movement of the lid portion.

The first panel of the lid locking component may be directly hingedly connected to a lower edge of the lid back wall. This may be particularly applicable when the lid locking component is integrally formed with the lid back wall.

Alternatively, the lid locking component may further comprise a third panel and the first panel of the lid locking component may be hingedly connected to a lower edge of the third panel. In such embodiments, the third panel may be affixed to the inner surface of the lid back wall, for example, by an adhesive or any other suitable means. In such embodiments, the hinge connecting the first panel of the lid locking component to the third panel of the lid locking component may form the hinge about which the lid portion may pivot relative to the box portion.

The lid locking component may further comprise a first side panel and a second side panel, the first side panel and the second side panel being opposed to each other, and each side panel being connected to the first panel at a respective side edge of the first panel. Said first side panel and said second side panel may help to guide movement of the lid locking component as the lid portion moves between the open position and the closed position. As described in more detail below, said first and second side panels may help to define a holding mechanism for preventing the lid portion from moving linearly beyond the open position. Said first side panel and said second side panel may each be attached to the first panel at a lower portion of the first panel. Said first side panel and said second side panel may each be folded by about 90 degrees relative to the first panel, at the respective side edges of the first panel.

The wall of the box portion having the box locking component may be provided with a release element for facilitating disengagement of the lid locking component from the box locking component. Namely, the release element may be configured to enable the locking mechanism to transition from the locked state to the unlocked state in response to pressure exerted on the container by a user. In particular, the release element is configured to enable a user to interact with the locking mechanism to instigate such a transition. Preferably, when the lid portion is in the closed position, the release element of the box portion overlies at least a portion of the lid locking component.

In some embodiments, the release element may comprise a cut-out in the wall of the box portion having the box locking component. The cut-out may be positioned adjacent to a portion of the lid locking component, when the lid portion is in the closed position. In such embodiments, the cut-out allows a user to access the lid locking component and disengage it from the box locking component. For example, a user may insert one of their fingers through the cut-out and push the lid locking component away from the box locking component to disengage lid locking component from the box locking component.

In some embodiments, the release element comprises a release tab formed by at least one cut-line in the wall of the box portion having the box locking component. For example, the wall of the box portion having the box locking component may comprise a U-shaped cut, which defines at least part of the perimeter of a release tab in said wall of the box portion. The release tab may be deflectable relative to the remainder of the wall of the box portion. This can allow the release tab to be moved independent of the wall of the box portion, in response to pressure from a user. The release tab may be positioned adjacent to a portion of the lid locking component, when the lid portion is in the closed position. Thus, in use, a user can press on the release tab to translate a force to the lid locking component to disengage the lid locking component from the box locking component.

By providing a release element in the form of a release tab, the means for unlocking the locking mechanism can be incorporated into the container with minimal visual impact on the container. The means for unlocking the container may therefore not be obviously visually apparent. This may therefore help to reduce the risk of the container being inadvertently opened.

Preferably, the box portion comprises a box portion back wall. Preferably, the box locking component is provided on the inner surface of the box portion back wall. Preferably, the release element is provided on the box portion back wall. By providing one or both of the release element and the box locking component on the box portion back wall, the locking mechanism may be less visible to a user, during normal handling of the container.

The box portion may further comprise a box portion front wall, box portion bottom wall, and first and second opposing box portion side walls.

The container may further comprise a holding mechanism for preventing the lid portion from moving linearly beyond the open position. The holding mechanism may therefore prevent the lid portion from being separated from the box portion. The holding mechanism may advantageously provide a user with an indication that the lid portion has reached the open position. More specifically, when the holding mechanism engages to prevent the lid portion from moving linearly beyond the open position, the user is provided with a tactile indication that the lid portion has reached the open position.

The holding mechanism may comprise at least one holding edge of the lid locking component and at least one corresponding holding edge in the box portion, wherein the at least one holding edge of the lid locking component is configured to engage with the at least one holding edge of the box portion when the lid portion is in the open position to prevent the lid portion from moving linearly beyond the open position. As described in more detail below, the at least one holding edge of the lid locking component an upper edge of the first panel of the lid locking component.

Preferably, the box portion comprises an inner frame. Preferably, the holding edge in the box portion is provided by the inner frame in the box portion. Preferably, the holding edge in the box portion is provided by one or both of the lower edge of a first inner fame side wall and the lower edge of a second inner frame side wall.

In some embodiments, the holding mechanism comprises an extendable member connecting a part of the box portion to a part of the lid portion. The extendable member being configured to be changeable between a retracted configuration when the lid portion is in the closed position, and an extended configuration when the lid portion is in the open position. The extendable member may be provided in the form of a strip of folded panels, with a first end panel of the strip being secured to a part of the box portion and a second opposing end panel of the strip being secured to a part of the lid portion. For example, the first end panel of the strip may be secured to the inner surface of the box portion bottom wall. The second end panel may be secured to the first panel of the lid locking component. The extendable member may therefore be concertina-like when it changes between its retracted and extended configurations.

The inner frame of the box portion may comprise a front panel. The inner frame front panel may underlie an inner surface of the box portion front wall. The inner frame front panel may be secured to the inner surface of the box portion front wall, for example, by an adhesive. The inner frame may further comprise first and second opposing inner frame side panels, each inner frame side panel depending from a respective side edge of the inner frame front panel. The inner frame side panels may underlie an inner surface of a respective box portion side wall. The inner frame side panels may be secured to the inner surface a respective box portion side wall, for example, by an adhesive.

The first inner frame side panel and second inner frame side panel may each partially overlap with a corresponding one of the first and second side panels of the lid locking component. Where the first inner frame side panel overlaps with the first side panel of the lid locking component, the first side panel of the lid locking component may be disposed between the first inner frame side panel and the first box portion side wall. Where the second inner frame side panel overlaps with the second side panel of the lid locking component, the second side panel of the lid locking component may be disposed between the second inner frame side panel and the second box portion side wall.

The inner frame may further comprise a first inner frame back panel and a second inner frame back panel, each inner frame back panel depending from a rear edge of a respective inner frame side panel. The inner frame back panels may each extend across only a portion of the back of the box portion.

The first inner frame back panel and the second inner frame back panel may each partially overlap with the first panel of the lid locking component. Where the first inner frame back panel overlaps with the first panel of the lid locking component, the first inner frame back panel may be disposed between the first panel of the lid locking component and the box portion back wall. Where the second inner frame back panel overlaps with the first panel of the lid locking component, the second inner frame back panel may be disposed between the first panel of the lid locking component and the box portion back wall.

The first inner frame side panel and first inner frame back panel may together form a first corner portion of the inner frame. The first corner portion of the inner frame may be configured to engage with a corresponding first corner portion of the lid locking component, when the lid portion is in the open position. The first corner portion of the lid locking component may be formed from the combination of the first panel of the lid locking component and the first side panel of the lid locking component. In particular, the first corner portion of the inner frame may comprise a lower edge and the first corner portion of the lid locking component may comprise an upper edge. The lower edge of the first corner portion of the inner frame may be configured to engage with the upper edge of the first corner portion of the lid locking component, when the lid portion is in the open position. In some embodiments, the engaging part of the upper edge of the first corner portion may be provided by the first panel of the lid locking component and the engaging part of the lower edge of the first corner portion of the inner frame may be provided by the first inner frame side panel. Such engagement may act to prevent the lid portion from moving linearly beyond the open position. An example of this can be seen in FIGS. 4A and 4B, which are described in more detail below.

The second inner frame side panel and second inner frame back panel may together form a second corner portion of the inner frame. The second corner portion of the inner frame may be configured to engage with a corresponding second corner portion of the lid locking component, when the lid portion is in the open position. The second corner portion of the lid locking component may be formed from the combination of the first panel of the lid locking component and the second side panel of the lid locking component. In particular, second first corner portion of the inner frame may comprise a lower edge and the second corner portion of the lid locking component may comprise an upper edge. The lower edge of the second corner portion of the inner frame may be configured to engage with the upper edge of the second corner portion of the lid locking component, when the lid portion is in the open position. In some embodiments, the engaging part of the upper edge of the second corner portion may be provided by the first panel of the lid locking component and the engaging part of the lower edge of the second corner portion of the inner frame may be provided by the second inner frame side panel. Such engagement may act to prevent the lid portion from moving linearly beyond the open position.

The box locking component may comprise at least one panel affixed to the inner surface of a wall of the box portion, the at least one panel providing a barrier for engaging with the lid locking component. In particular, the barrier may provide an edge for engaging with a corresponding edge of the lid locking component, to prevent the lid portion from moving linearly from the closed position to the open position.

In some embodiments, the box locking component comprises a first panel having an outer surface affixed to the inner surface of a wall of the box portion, and a second panel connected to the first panel by a first fold line. The second panel is folded about the first fold line by about 180 degrees relative to the first panel. The second panel is affixed to the inner surface of the first panel. This can advantageously provide a simple yet effective way to ensure that the box locking component provides a sufficiently sized barrier for engagement with the lid locking component. This can help to accommodate for any minor fluctuations in the position of the box portion wall carrying the box locking component, relative to the position of the lid locking component. Such fluctuations may occur during transportation, or over time as the container is handled by a user and subjected to deformation from external force, or both.

According to the present disclosure, there is provided a method of making a container for consumer goods. The method comprises the steps of: providing a first blank for forming a housing of the container, the first blank having a first portion for forming a box portion of the container and a second portion for forming a lid portion of the container, wherein a first surface of the first portion of the first blank is provided with a box locking component; providing a second blank for forming a lid locking component of the container; placing the second blank on the first blank, such that part of the lid locking component of the second blank abuts the box locking component of the first blank; securing the second blank to the second portion of the first blank; placing one or more consumer goods on one or both of the first blank and the second blank; folding the first blank about the consumer goods to form the box portion and the lid portion of the container; and cutting the first portion of the first blank from the second portion of the first blank.

By assembling the container from the above described arrangement of the first blank and the second blank, the container can be assembled, and can incorporate a locking mechanism, without requiring major changes to existing manufacturing processes and machinery. In particular, the first blank for forming the housing of the container does not need to be adapted in size or shape to accommodate the locking mechanism. By securing the second blank to the first blank before consumer goods are introduced to the assembly process, the lid locking component can be easily and reliably placed in an engaged condition relative to the box locking component. By cutting the first portion of the first blank from the second portion of the first blank after the housing has been assembled around the consumer goods, the position of the lid portion of the container relative to the box portion of the container can be reliably controlled. In particular, a flush arrangement between the walls of the lid portion of the container and corresponding walls of the box portion of the container can be ensured.

The box locking component may be formed from a third blank. The method may further comprise the step of providing a third blank and securing the third blank to the first surface of the first portion of the first blank to form the box locking component on the first surface of the first blank. The third blank may comprise a first panel and a second panel. The method may further comprise folding the second panel by about 180 degrees relative to the first panel, and securing the second panel. The step of folding the second panel relative to the first panel may occur before the step of securing the third blank to the first surface of the first portion of the first blank.

The method may further comprise the step of providing a fourth blank for forming an inner frame for the container. The method may further comprise the step of placing the fourth blank on the one or more consumer goods. The method may further comprise the step of folding one or more panels of the fourth blank around the one or more consumer goods. The one or more consumer goods may be provided as a plurality of consumer goods in a bundle. The bundle may comprise a wrapper wrapped around the plurality of consumer goods. The second blank may be provided on the opposing side of the bundle of consumer goods to the side on which the fourth blank is placed.

The method may further comprise the steps of folding one or more side panels of the second blank about a corresponding side of the bundle of consumer goods, and folding one or more side panels of the fourth blank about a corresponding side of the bundle of consumer goods, such that each side panel of the second blank at least partially overlaps with a side panel of the fourth blank.

The method may further comprise the step of placing the bundle of consumer goods together with the folded second laminar blank and the folded fourth laminar blank on the first laminar blank, before the step of folding the first blank about the consumer goods to form the box portion and the lid portion of the container.

The container formed by the above described method may comprise any of the features described above in respect of the container having the locking mechanism.

Containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (front and back) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof.

The container may comprise a plurality of consumer goods. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the lid of the container is in a respective open position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles, such as smoking articles. The aerosol-generating articles may be arranged in different collations, depending on the total number.

Through an appropriate choice of dimensions, containers according to the invention may be designed to hold different types or numbers of consumer goods.

The invention will now be further described, by way of example only, with reference to the accompanying drawings in which.

Figure 1:
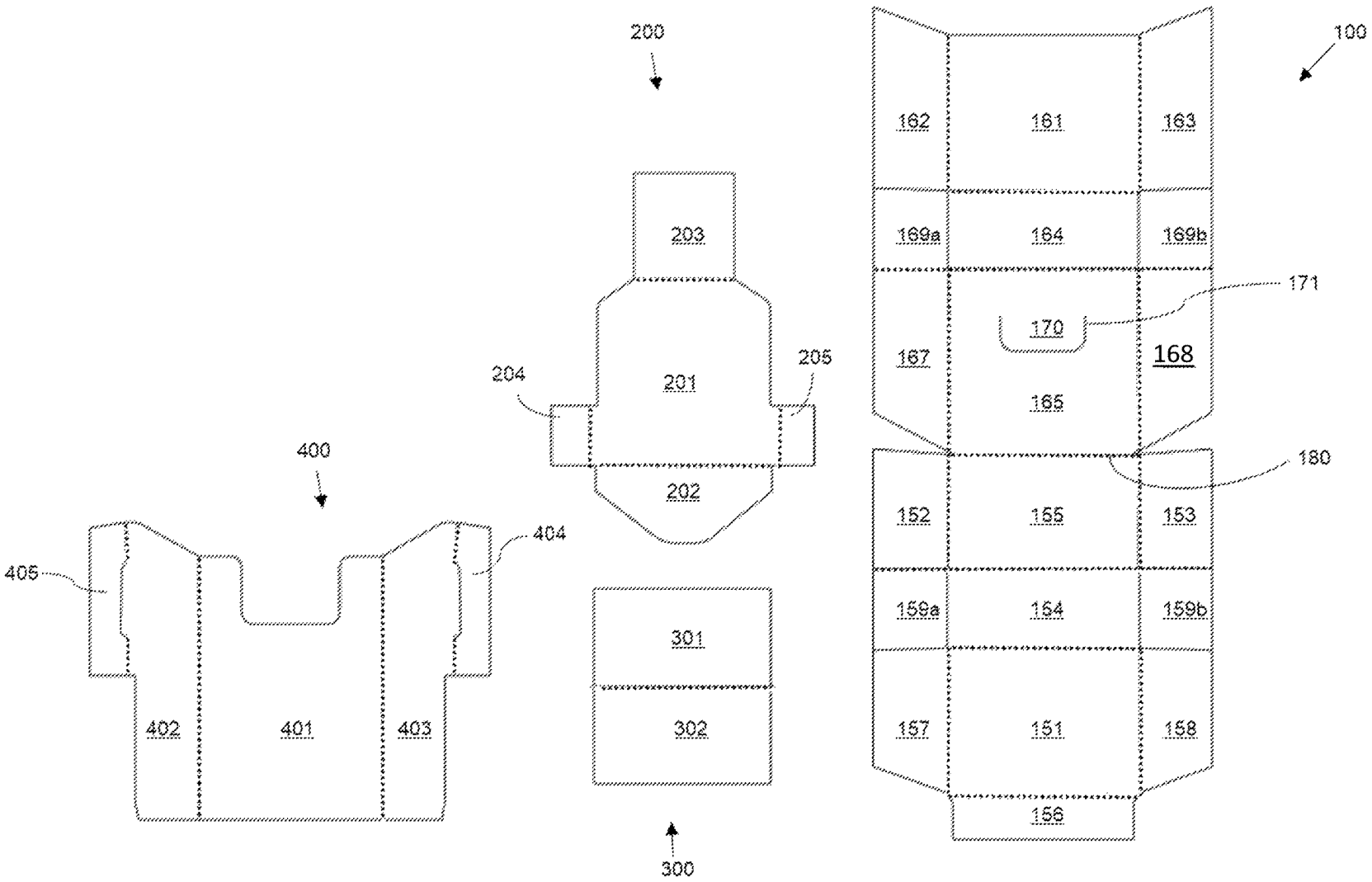
FIG. 1 shows a plurality of laminar blanks for forming a container according to the present invention.
Figure 2A:
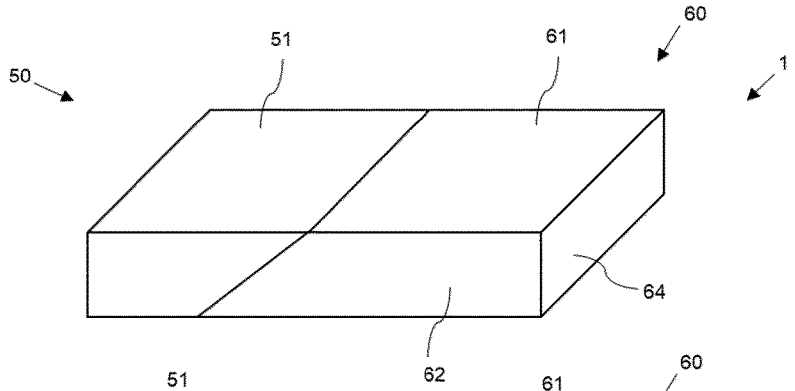
FIGS. 2A to 2C show a container according to the present invention in different configurations.
Figure 2B:
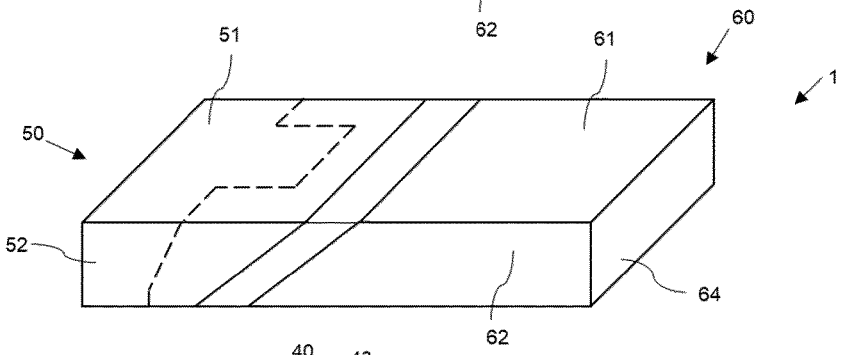
Figure 2C:
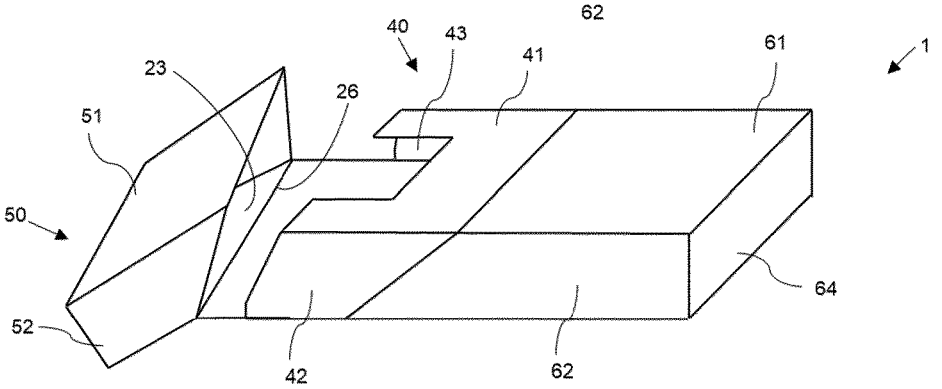

FIG. 1 shows four laminar blanks for forming a container 1 according to the present invention, namely a first laminar blank 100, a second laminar blank 200, a third laminar blank 300 and a fourth laminar blank 400. The laminar blanks can be used to form a container 1 as shown in FIGS. 2A to 2C. The dashed lines indicate fold lines, and solid lines indicate cut lines in the laminar blanks.

The first laminar blank 100 is configured to form a lid portion 50 of the container 1 and a box portion 60 of the container. The first laminar blank 100 comprises a lid portion front wall panel 151, first and second lid portion outer side wall panels 152, 153, a lid portion top wall panel 154, a lid portion back wall panel 155, a lid portion front under panel 156, first and second lid portion inner side wall panels 157, 158 and first and second lid portion dust flaps 159*a*, 159*b*. These panels together form the lid portion 50 of the container 1.

The first laminar blank 100 further comprises a box portion front wall panel 161, first and second box portion outer side wall panels 162, 163, a box portion bottom wall panel 164, a box portion back wall panel 165, first and second box portion inner side wall panels 167, 168 and first and second box portion dust flaps 169*a*, 169*b*. These panels together form the box portion 60 of the container 1.

The first laminar blank 100 further comprises a portion 170 on its box portion back wall panel 165 for defining a release tab 70 in the container 1. This 170 portion is partially delimited by a U-shaped cut line 171 in the box portion back wall panel 165. The release tab 70 is configured to facilitate unlocking of the locking mechanism, as will be described in more detail below with references to FIGS. 3A to 3C.

The second laminar blank 200 is configured to form a lid locking component 20, which forms part of the lid portion 50 of the assembled container 1. The second laminar blank 200 comprises a first panel 201 and a second panel 202 depending from a lower edge of the first panel 201. When the container 1 is assembled the second panel 202 is folded by about 180 degrees relative to the first panel 201 about a fold line extending across the lower edge of the first panel 201.

The second laminar blank 200 further comprises a third panel 203 depending from an upper edge of the first panel 201 by a lid locking component fold line 206. When the container 1 is assembled the third panel 203 is affixed to the inner surface of the lid portion back wall panel 155. This attaches the lid locking component 20 to the lid portion 50. The lid portion 50 includes the lid front wall 51, first lid side wall 52, second lid side wall, lid top wall and lid back wall. The lid portion 50 therefore has a three-dimensional cup shape and covers the access opening of the box portion 60 of the container 1, when the lid portion is in the closed position.

When the container 1 is assembled the lid locking component fold line 206 between the first and third panels 201, 203 of the lid locking component 20 forms a hinge line 26 for the lid portion 50. As will be described in more detail below, when the lid portion 50 is in an open position, the lid portion 50 is able to pivot about this hinge line 26. This can help to improve access to any consumer goods housed in the box portion 60.

The second laminar blank 200 further comprises first and second side wall panels 204, 205 each depending from a respective side edge of the first panel 201 of the second laminar blank 200.

The third laminar blank 300 is configured to form a box locking component 30 for the assembled container 1. The third laminar blank comprises a first panel 301 which is affixed to the inner surface of the box portion back wall panel 165 in the assembled container 1. The third laminar blank also comprises a second panel 302, which is folded by about 180 degrees relative to the first panel 301 about a fold line extending across the lower edge of the first panel 301, in the assembled container 1.

When the container is assembled, a free edge on the second panel 202 of the second laminar blank 200 is configured to engage with a barrier created by the edge of the folded third laminar blank 300 to form a locking mechanism for the container 1. This will be described in more detail below.

The fourth laminar blank 400 is configured to form an inner frame 40 for the assembled container 1. The fourth laminar blank 400 comprises an inner frame front wall panel 401, a first inner frame side wall panel 402, a second inner frame side wall panel 403, a first inner frame back wall panel 404 and a second inner frame back wall panel 405. When the container is assembled, certain free edges on the inner frame side wall panels 402, 403 and inner frame back wall panels 404, 405 are configured to respectively abut and engage with certain corresponding free edges on the lid locking element first panel 201 and lid locking element side panels 204, 205. Such engagement forms a holding mechanism, which acts to prevent the lid portion 50 from sliding beyond an open position relative to the box portion 60. This will be described in more detail below with reference to FIGS. 4A and 4B.

With reference now to FIGS. 2A, 2B and 2C, the lid portion 50 of the container 1 is configured to be linearly movable relative to the box portion 60. In particular, the lid portion 50 can move between a closed position (as shown in FIG. 2A) and an open position (as shown in FIG. 2C). In the closed position, the lid portion 50 covers an access opening in the top of the box portion 60, and thus prevents access to consumer goods housed in the box portion 60. For the sake of clarity, consumer goods are not shown in FIGS. 2A to 2C. In the open position, the access opening of the box portion 60 is exposed and a consumer is able to access any consumer goods housed in the box portion 60. Furthermore, in the open position in FIG. 2C, part of the lid portion 50 is able to pivot about hinge line 26 relative to the box portion 60. This enhances the access to the interior of the box portion 60 by moving the lid portion 50 further away from the access opening of the box portion 60.

FIG. 2B depicts a configuration for the container where the lid portion 50 resides between the open and closed position. In this position, the lid portion has moved linearly away from the box portion 60, when compared to the open position of FIG. 2A. However, in such a position, the access opening is not exposed, due to the presence of the inner frame 40. Furthermore, the presence of the inner frame 40 prevents pivoting of the lid portion 50 relative to the box portion, about hinge line 26. This is because at least the top edge of the inner frame front wall 41 will engage with the inner surface of the lid front wall 51, if a user tried to pivot this part of the lid portion 50 about hinge line 26. This engagement would block any such pivoting.

Figure 3A:
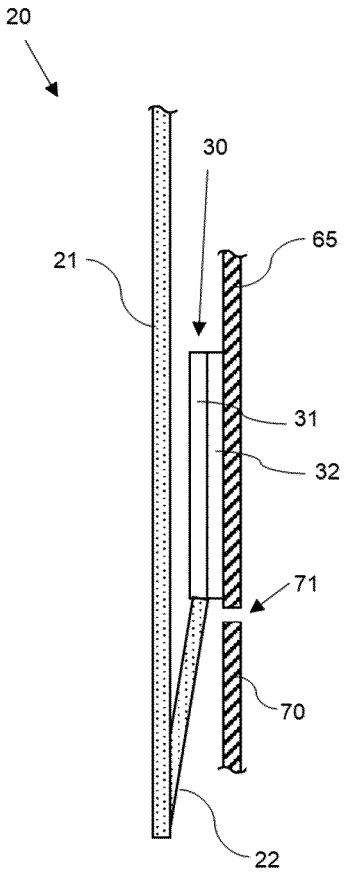
FIGS. 3A to 3C show a cross-sectional view of a locking mechanism for a container according to the present invention in different configurations.
Figure 3B:
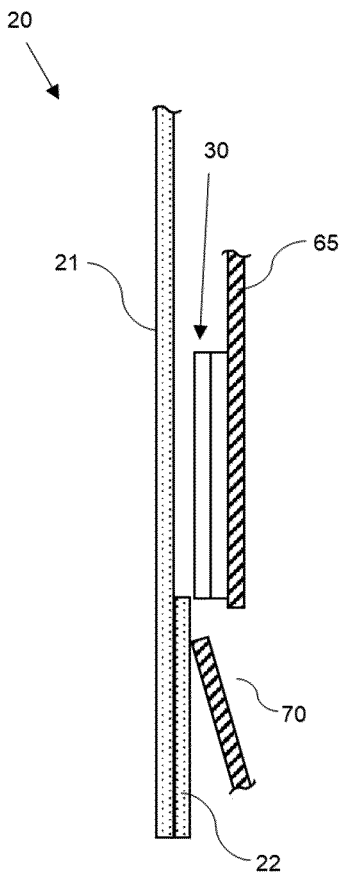
Figure 3C:
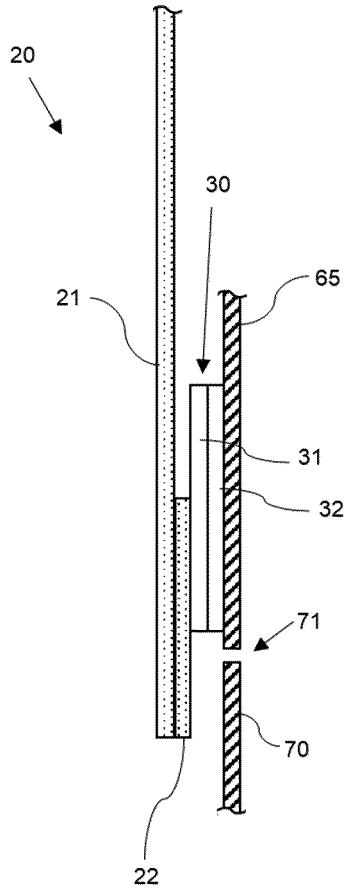

FIGS. 3A to 3C show a cross-sectional view of a locking mechanism for a container according to the present invention. The Figures depict the locking mechanism in various configurations.

The locking mechanism comprises the lid locking component 20. The first and second panel 21, 22 of the lid locking component are shown in FIGS. 3A to 3C. The locking mechanism also comprises the box locking component 30. The box locking component 30 is formed of first and second panels 31, 32. The first and second panels 31, 32 are secured to each other in a back-to-back arrangement. The box locking component 30 is secured to the inner surface of the box portion back wall 65 (only a portion of which is shown in FIGS. 3A to 3C).

The box portion back wall 65 comprises a cut line 71. The cut line 71 partially delimits the perimeter of a release tab 70 in the box portion back wall 65. The release tab 70 is deflectable relative to the rest of the box portion back wall 65.

In FIG. 3A the locking mechanism is in a locked state. In this state, the lid portion 50 is in the closed position (for example, as shown in FIG. 2A), and prevented from linear movement relative to the box portion 60, by virtue of the locking mechanism. The locking mechanism is locked by virtue of engagement of a free edge of the second panel 22 of the lid locking component 20 with a barrier created by the box locking component 30. To unlock the locking mechanism, a user presses on the release tab 70 to cause the release tab 70 to deflect inwards relative to the box portion 60. The release tab 70 then comes into contact with the second panel 22 of the lid locking component 20 and pushes the second panel 22 away from the box locking component 30. This causes the free edge of the second panel 22 of the lid locking component to disengage from the barrier created by the box locking component, as shown in FIG. 3B. FIG. 3B therefore shows the locking mechanism in an unlocked state, with the lid portion 50 still being in the closed position. However, because the locking mechanism is now unlocked, the lid portion 50 can now move linearly relative to the box portion 60 and towards the open position. Consequently, after pressing on the release tab 70 and unlocking the locking mechanism, a user can slide the lid portion 50 away from the box portion 60 to gain access to the consumer goods. This results in the first and second panels 21, 22 of the lid locking component 20 being moved upwards relative to the box locking component 30, as shown in FIG. 3C. FIG. 3B therefore shows the locking mechanism in an unlocked state, with the lid portion 50 being in the open position.

When the user has finished accessing the consumer goods, the user can slide the lid portion 50 back towards the box portion 60 to close the container 1. This reverts the lid locking component 20 to a position corresponding to that shown in FIG. 3B. However, as the user is now no longer pressing on the release tab 70, the second panel 22 of the lid locking component 20 can move back to the position shown in FIG. 3A to engage with the box locking component 30. This results in the locking mechanism reverting to the locked state of FIG. 3A. The second panel 22 can automatically revert to the position shown in FIG. 3A in such circumstances, because of the biasing force created by the fold line between the first and second panels 21, 22 of the lid locking component 20.

Figure 4A:
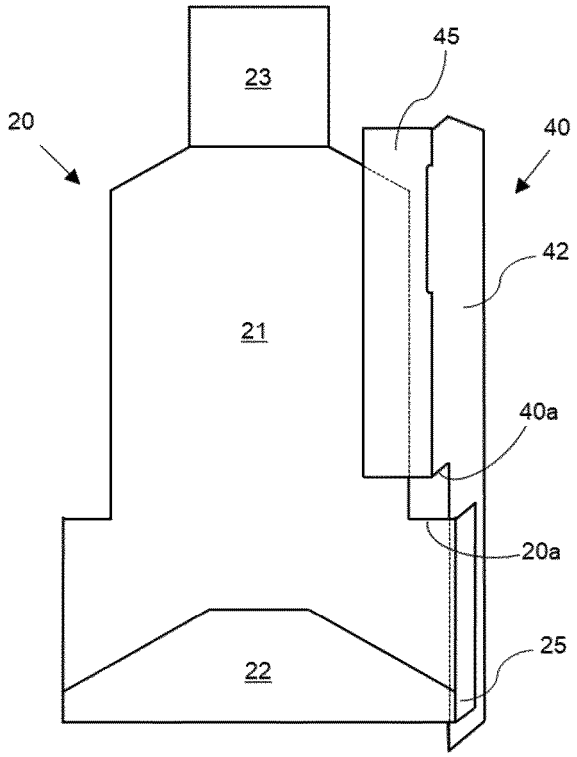
FIGS. 4A and 4B show shows a partial view of an inner frame and lid locking component for a container according to the present invention in different configurations.
Figure 4B:
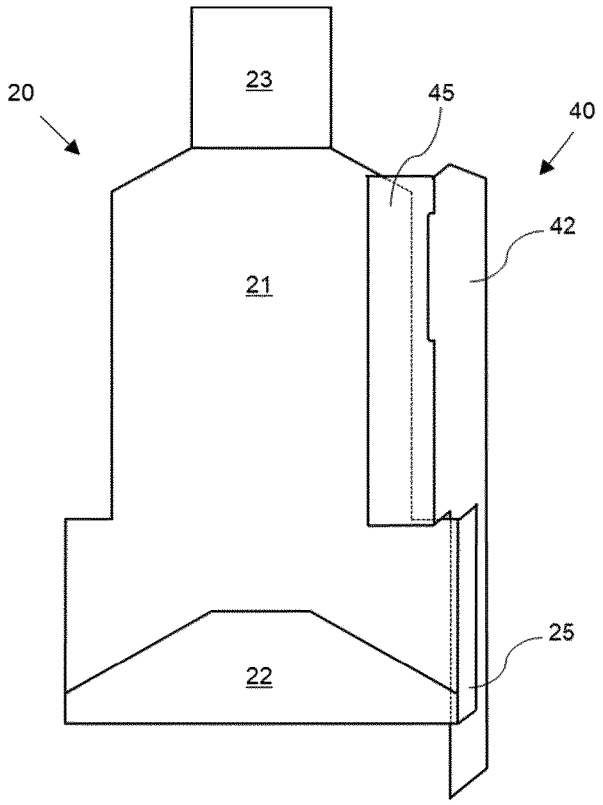

FIGS. 4A and 4B show shows a partial view of an inner frame 40 and lid locking component 20 for a container according to the present invention. The partial view shows the first inner frame back wall 45, the first inner frame side wall 42, which together form a first corner portion for the inner frame 40. The partial view also shows the lid locking component first side panel 25 and the lid locking component first panel 21, which together form a first corner portion of the lid locking component 20. The partial view does not shown the inner frame front wall, second inner frame side wall and second inner frame back wall. The inner frame 40 and lid locking component 20 are shown in different configurations to illustrate how said components create a holding mechanism for the container 1.

FIG. 4A corresponds to the positions shown in FIGS. 2A and 3A, where the lid portion 50 is in the closed position, and the locking mechanism is in the locked state. In this position, the lid locking component 20 is linearly positioned relative to the inner frame 40, such that a space exists between an upper edge 20*a* of the first corner portion of the lid locking component 20, and a corresponding lower edge 40*a* of the first corner portion of the inner frame 40.

When the locking mechanism is unlocked and the lid portion 50 is slid towards the open position, the upper edge 20*a* of the lid locking component 20 moves upwards towards the lower edge 40*a* of the inner frame 40 until they abut one another in the position shown in FIG. 4B. At this point, such abutment prevents further linear movement of the lid locking component 20 relative to the inner frame 40 and box portion 60. This position of FIG. 4B corresponds to the open position for the lid portion 50, and hence the positions shown in FIGS. 2C and 3C. In the embodiment shown in FIG. 4B, the engaging part of the upper edge 20*a* of the lid locking component 20 is provided by an upper edge of the first panel 21 of the lid locking component 20, and the engaging part of the lower edge 40*a* of the inner frame 40 is provided by a lower edge of the first inner frame side wall 42.

The invention claimed is:

1. A container for consumer goods, the container comprising:

an outer housing comprising a box portion and a lid portion, the box portion defining an internal volume for housing consumer goods and having an access opening for providing access to the consumer goods, wherein the lid portion is linearly movable relative to the box portion between a closed position, in which the lid portion covers the access opening and cannot pivot relative to the box portion about a hinge line to expose the access opening, and an open position, in which the lid portion can pivot relative to the box portion about the hinge line to expose the access opening is exposed, and wherein the container is configured such that the lid portion can pivot relative to the box portion about a hinge when the lid portion is in the open position, wherein the container further comprises a lid locking component attached to or integrally formed with the lid portion, and a box locking component provided on the inner surface of a wall of the box portion, wherein, the lid locking component and the box locking component form a locking mechanism for the container, and wherein, when the lid portion is in the closed position, the locking mechanism is configured to be transitionable between:

a locked state, in which a portion of the lid locking component engages with a portion of the box locking component to prevent the lid portion from moving linearly from the closed position to the open position, and an unlocked state, in which the lid locking component is not engaged with the box locking component, and the lid portion is able to move linearly from the closed position to the open position.

2. The container according to claim 1, wherein the lid portion comprises a lid front wall, a lid back wall, a lid top wall and first and second opposing lid side walls.

3. The container according to claim 2, wherein the lid locking component is attached to the lid back wall.

4. The container according to claim 2, wherein the lid locking component comprises a first panel hingedly connected to the lid back wall and a second panel connected to the first panel, the second panel being configured to engage with the box locking component when the lid portion is in the closed position.

5. The container according to claim 4, wherein the second panel is connected to the first panel by a first fold line, and folded about the first fold line to position the second panel between the first panel of the lid locking component and the wall of the box portion having the box locking component.

6. The container according to claim 3, wherein the lid locking component further comprises a first side panel and a second side panel, the first side panel and the second side panel being opposed to each other, and wherein each side panel of the lid locking component is connected to a first panel of the lid locking component at a respective side edge of the first panel of the lid locking component.

7. The container according to claim 1, wherein the wall of the box portion having the box locking component is provided with a release element for facilitating disengagement of the lid locking component from the box locking component.

8. The container according to claim 7, wherein the release element comprises a release tab formed by at least one cut-line in the wall of the box portion.

9. The container according to claim 7, wherein, when the lid portion is in the closed position, the release element of the box portion overlies at least a portion of the lid locking component.

10. The container according to claim 7, wherein the box portion comprises a box portion back wall and the release element is provided on the box portion back wall.

11. The container according to claim 1, wherein the container further comprises a holding mechanism for preventing the lid portion from moving linearly beyond the open position.

12. The container according to claim 11, wherein the holding mechanism comprises at least one holding edge of the lid locking component and at least one corresponding holding edge in the box portion, wherein the at least one holding edge of the lid locking component is configured to engage with the at least one holding edge in the box portion when the lid portion is in the open position to prevent the lid portion from moving linearly beyond the open position.

13. The container according to claim 12, wherein the box portion further comprises an inner frame, the inner frame providing the at least one holding edge in the box portion.

14. The container according to claim 1, wherein the box locking component comprises at least one panel affixed to the inner surface of a wall of the box portion, the at least one panel providing a barrier for engaging with the lid locking component.

15. A method of making a container for consumer goods, the method comprising:

providing a first blank for forming a housing of the container, the first blank having a first portion for forming a box portion of the container and a second portion for forming a lid portion of the container, wherein a first surface of the first portion of the first blank is provided with a box locking component;

providing a second blank for forming a lid locking component of the container;

placing the second blank on the first blank, such that part of the lid locking component of the second blank abuts the box locking component of the first blank;

securing the second blank to the second portion of the first blank;

placing one or more consumer goods on one or both of the first blank and the second blank;

folding the first blank about the consumer goods to form the box portion and the lid portion of the container; and cutting the first portion of the first blank from the second portion of the first blank.

* * * * *